US005561259A

United States Patent [19]

Herbage et al.

[11] Patent Number: 5,561,259

[45] Date of Patent: Oct. 1, 1996

[54] DECOY FLARE WITH SEQUENCER IGNITION

[75] Inventors: David W. Herbage, Jackson; Samuel H. Smith, Medina, both of Tenn.

[73] Assignee: Alliant Techsystems Inc., Hopkins, Minn.

[21] Appl. No.: 322,913

[22] Filed: Oct. 13, 1994

[51] Int. Cl.[6] ..... F42B 12/48; F42C 15/24

[52] U.S. Cl. ..... 102/334; 102/251; 102/256; 102/257

[58] Field of Search ..... 102/334, 251, 102/256, 259

[56] References Cited

U.S. PATENT DOCUMENTS

| | | | |
|---|---|---|---|
| 3,391,640 | 7/1968 | Weldon et al. | 102/87 |
| 3,712,224 | 1/1973 | Hanzel | 102/37.6 |
| 4,155,306 | 5/1979 | Herold et al. | 102/35 |
| 4,498,392 | 2/1985 | Billard et al. | 102/342 |
| 4,624,186 | 11/1986 | Widera et al. | 102/336 |
| 4,976,201 | 12/1990 | Hamilton | 102/323 |
| 4,982,663 | 1/1991 | Scheve et al. | 102/251 |
| 5,074,216 | 12/1991 | Dunne et al. | 102/334 |
| 5,243,917 | 9/1993 | Komstadius | 102/489 |
| 5,400,712 | 3/1995 | Herbage et al. | 102/361 |

OTHER PUBLICATIONS

US Air Force Blueprint No. 8856669 & 8856664.

*Primary Examiner*—Peter A. Nelson

*Attorney, Agent, or Firm*—Vidas, Arrett & Steinkraus, P.A.

[57] ABSTRACT

A decoy flare with a sequenced ignition is disclosed. The flare comprises a case including an aperture for an impulse cartridge, a segment of pyrotechnic material and a sequencer igniter. The sequencer igniter includes a housing having an aperture, an ignition pellet and an interrupt positioned to cover the aperture when the sequencer igniter is in the case thereby separating the ignition pellet and the pyrotechnic material. When the impulse cartridge is ignited the segment of pyrotechnic material and the sequencer igniter move out of the case, the ignition pellet is ignited, the interrupt moves to uncover the aperture and the segment of pyrotechnic material is ignited.

13 Claims, 1 Drawing Sheet

DECOY FLARE WITH SEQUENCER IGNITION

FIELD OF THE INVENTION

This invention pertains to the field of decoy flares, and more particularly to the use of pyrotechnic sequencers with decoy flares for protecting aircraft from hostile missiles, aircraft and the like having guidance systems that target the infrared energy from the aircraft's jet engines.

BACKGROUND OF THE INVENTION

Previous infrared flare devices for use on Navy aircraft with an AN-ALE 39 dispenser utilize pull wire igniters to ignite the flare when launched. These infrared flare devices have a very poor safety record. Numerous accidents have been caused by igniting flares. The accidental ignitions occur during manufacture; loading, unloading, and handling associated with the flares use on aircraft; and in the creation of hang-fire situations on aircraft in flight and upon landing.

The flares which utilize pull wire igniters are complicated and easily prone to malfunction as stated above. The pull wire itself is covered by phosphorous particles. This pull wire is, in essence, a match which is prone to ignite if the wire is disturbed. Also, the mechanics of these flares include many parts which require ideal conditions for handling and use.

Consequently, a need remains for a reliable, safe decoy flare to be used with aircraft. The present invention eliminates the safety problems of previous flares and provides a flare safe for manufacture and use with an improved design.

SUMMARY OF THE INVENTION

A decoy flare having a case including a port for an impulse cartridge, a flare pellet, a pyrotechnic sequenced ignition assembly including a pyrotechnic pellet, an interrupt, and a plug is disclosed. The decoy flare is dispensed from a countermeasure dispenser using an impulse cartridge. Upon initiation of the impulse cartridge, the internal payload (the flare pellet and the sequenced ignition assembly) begins to move from the case. The hot particles from the impulse cartridge travel through a hole in a plug of the sequencer and ignite a pyrotechnic pellet in the pyrotechnic sequencer on the aft section of the flare pellet.

As the flare pellet and sequencer assembly depart the flare case, the interrupt is removed from between the pyrotechnic pellet and flare grain assembly allowing the flame to ignite the flare pellet.

One feature of the invention is the pyrotechnic sequencer. Use of the sequencer improves safety, enhances production handling, increases reliability, and results in a lower manufacturing cost. One embodiment of the invention includes a decoy flare having a pyrotechnic sequencer igniter fabricated from a high strength plastic, containing a spring loaded interrupt cross slide/bore rider, and a pyrotechnic ignition pellet.

One embodiment of the invention includes a skirt, housing, legs, and cavity of the sequencer formed as an integral nylon piece. This allows for easier manufacturing and reliability.

Another advantage of the invention is that the device is not friction sensitive like previous devices which include a pull wire igniter. Also, the invention can withstand exposure to a great deal of static electricity before ignition will occur. Yet another advantage is evident in the fact that even if the invention is disassembled accidental ignition is difficult due to the design of the flare.

BRIEF DESCRIPTION OF THE FIGURES

Other objects of the invention and many of the attendant advantages of the present invention will be readily appreciated as the same becomes better understood by reference to the following detailed description when considered in connection with the accompanying drawings, in which like reference numerals designate like parts throughout the several views.

DETAILED DESCRIPTION OF THE INVENTION

Figures 1, 2, 3, 4:
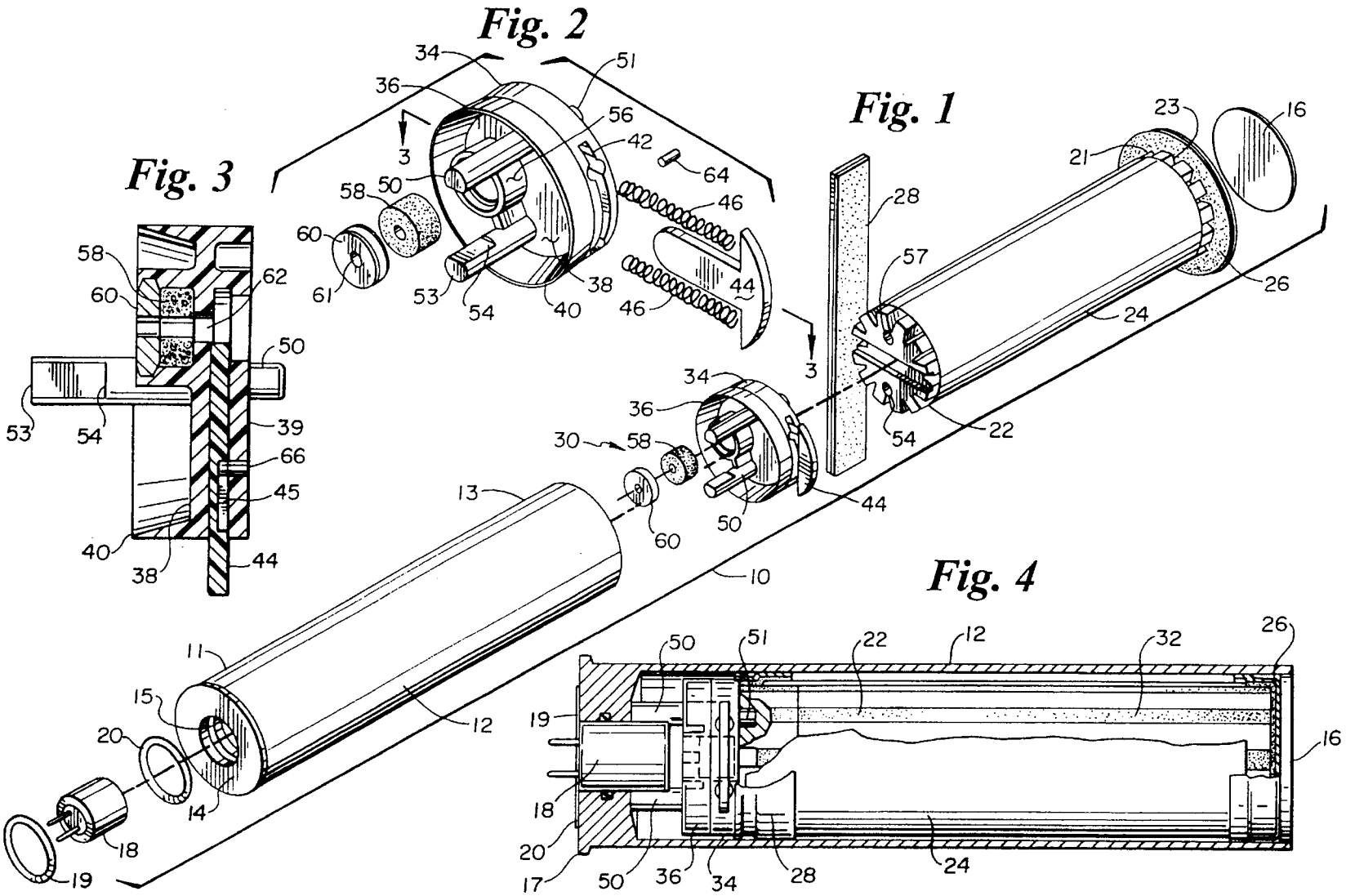
FIG. 1 illustrates an exploded perspective view of the invention.
FIG. 2 illustrates an exploded perspective view of the pyrotechnic sequencer of the invention.
FIG. 3 illustrates a cross sectional view of the pyrotechnic sequencer of the invention taken along line 3—3 in FIG. 2.
FIG. 4 illustrates a side elevational view with a partial cut away showing the invention as assembled.

While this invention may be embodied in many different forms, there are described in detail herein specific preferred embodiments of the invention. This description is an exemplification of the principles of the invention and is not intended to limit the invention to the particular embodiments illustrated.

Referring now to FIG. 1, there is shown a decoy flare 10. The preferred embodiment of the invention is a flare of the type that is dispensed from an AN/ALE-39 Countermeasure Dispenser or equivalent (not shown). The preferred embodiment is a 36 mm flare. The flare 10 includes a case 12. The case or housing 12 is generally cylindrical in shape and is made of aluminum in the preferred embodiment.

The case 12 includes an integral base 14 at the aft portion 11 of the case 12. Because the base 14 is integral with the case 12, failure due to the base coming off the case is eliminated. The base 14 is generally circular in shape and includes an aperture 15. Further, the base 14 includes a flange 17 which is utilized to retain the flare in the launcher of dispenser. The base 14 is made of aluminum in the preferred embodiment. A closure disk 16 is connected to the forward portion 13 of the case 12. The closure disk 16 is also made of aluminum and may be connected by any suitable means. In the preferred embodiment, the closure disk 16 is configured to fit within the case 12 and the edge of the case 12 is crimped to retain the closure disk 16. The base 14 and closure disk 16 enclose or secure the other parts of the flare 10 to be described below.

The flare 10 utilizes an impulse cartridge 18. The impulse cartridge 18 is a CCU-63/B impulse cartridge in the preferred embodiment and is well known to those skilled in the art. As is known, the cartridge 18 is used to launch the flare and begin the ignition. The impulse cartridge 18 fits within the aperture 15 of base 14. The cartridge 18 is received by the base 14 and is slip fit. In the preferred embodiment, an O-ring 20 is utilized with the cartridge to seal the cartridge 18 with the base 14. Further, an O-ring 19 is utilized at the base 14 of the case 12 so that the flare 10 is cushioned in the launcher.

The flare 10 further includes pyrotechnic flare pellet 22. The flare pellet or grain assembly 22 is the source of infrared energy for the flare 10. The grain assembly or flare pellet 22 is configured to fit within the case 12. In the preferred embodiment, the grain assembly 22 is a generally elongate cylindrical member having a plurality of longitudinal grooves 23. The grooves 23 allow for greater surface area exposure of the pyrotechnic material and therefore, facilitate combustion. The flare pellet 22 is a 55±5% magnesium, 27±5% PTFE, and 18±5% flouro elastomer composition in the preferred embodiment. Any one skilled in the art will understand that the flare pellet configuration or type of pyrotechnic material used may be of any appropriate shape and type which provides an infrared output sufficient to decoy a missile directed at a particular aircraft. The composition described above is utilized for use with Navy aircraft. The flouro elastomer is Viton A in the preferred embodiment and is made by Dupont.

A wrap 24 surrounds the grain assembly 22. An end disk 26 and tape seal 28 are also included. The end disk 26 is located on the forward end 21 of the grain assembly 22. The tape or seal 28 is utilized at the joint between the grain assembly 22 and the sequencer assembly 30 to be discussed below. The aluminum foil is wrapped around the flare pellet 22 and provides a seal and isolation from the environment to aid ignition. The wrap 24, disk 26, and seal 28 allow travel of the flame front the length of the grain 22 for a better ignition. The enclosure of the grain assembly 22 insures that the flame will not burn out due to the high speed travel of the pyrotechnic material 22 through the air. The wrap 24, disk 26 and seal 28 are adhesive backed aluminum foil in the preferred embodiment and burn or disintegrate with ignition.

Referring now to FIG. 4, igniter material 32 is shown. The igniter material 32 fills the grooves 23 created by the grain configuration 22. The igniter material 32 enhances the ignition of the flare pellet 22 by providing an additional combustible material for the flame front to travel through to more quickly ignite the grain assembly 22. The igniter material is a 55±5% magnesium, 27±5% PTFE, and 18±5% flouro elastomer composition in the preferred embodiment but any appropriate material may be utilized.

A sequencer assembly or sequencer igniter 30 is utilized in the invention. Referring to FIGS. 1, 2, and 3, the assembly 30 is shown. The assembly 30 includes a sequencer housing 34 and skirt 36. The housing 34 is generally circular in cross section and includes a base 38 and top 39. The skirt 36 is connected to the housing 34 at the base 38 and flares outwardly from the base 38 of the housing 34 to the edge 40. This slight outward flare of the skirt 36 allows for a good fit of the sequencer assembly 30 within the case 12. The sequencer assembly 30 is force fit within the case 12 causing the skirt 36 to compress. The compression of the skirt 36 creates a pressure seal when the impulse cartridge 18 is ignited which is necessary to insure a good launch of the flare pellet 22 and sequencer assembly 30.

Two legs 50 are connected to the housing 34. The legs 50 have forward and aft ends 51 and 53 and are perpendicular to the base 38 of the housing 34. The legs 50 extend beyond the housing 34 both beyond the base 38 and beyond the top 39 of the housing 34. In this manner, the legs 50 may be used to connect the assembly 30 to the flare pellet 22. The flare pellet 22 includes two apertures 54 and 57 for receiving the forward ends 51 of legs 50. An adhesive is used on the forward ends 51 of the legs 50 to provide a stronger connection to the flare pellet 22 in the preferred embodiment.

Also, the aft ends 53 of legs 50 abut the end cap 14 when the flare pellet 22 and sequencer assembly 30 are placed in case 12. In this way, the legs 50 create an area for the impulse cartridge 18. The impulse cartridge 18 is received by the aft ends 53 of the legs 50. The legs 50 have a cut out 54 to better receive and hold the cartridge 18 in the preferred embodiment. The cut out 54 in the legs 50 prevents forward movement of the cartridge 18. It should be understood that at least one leg is used in the invention but any number of legs may be utilized as appropriate.

A circular cup 56 is also connected to the floor 38 of the housing 34. In the preferred embodiment, the cup 56 is also connected to the legs 50 as shown in FIGS. 1, 2, and 3. This cup 56 is generally circular in cross section and is configured to receive an igniter pellet 58 and a sequencer plug 60 which are also part of the sequencer assembly 30. The igniter pellet 58 is generally cylindrical and includes an aperture. The igniter pellet 58 is of any suitable igniter composition. In the preferred embodiment, a 70±5% magnesium, 13±5% PTFE, and 172±5% flouro elastomer composition is utilized. The sequencer plug 60 is generally disk shaped and also includes an aperture 61 which is axially aligned with the aperture of the pellet 58. The plug 60 acts as a baffle or igniter obturator. The housing 34 also includes an aperture 62 which is axially aligned with the apertures of the pellet 58 and plug 60.

The housing 34 also includes a slot 42 for receiving a sequencer slider or interrupt 44 and at least one coil spring 46. In the preferred embodiment two coil springs 46 are utilized in the sequencer assembly 30. The slider 44 is generally t-shaped in the preferred embodiment and is made of a durable plastic such as acetal plastic or Super Tough Nylon made by Dupont and designated as ST801. The interrupt 44 includes a groove 45 which will be explained below. The interrupt 44 is utilized to block the advancement of any flame from the combustion of the igniter pellet 58 until the flare is launched and a safe distance from the launcher. The springs 46 are steel coil springs in the preferred embodiment and are situated on each side of the t-shaped interrupt 44.

It should be noted that the housing 34, skirt 36, legs 50, and cup 56 are integral in the preferred embodiment. The housing 34, skirt 36, legs 50 and cup 56 are made of Super Tough Nylon manufactured by Dupont and designated as ST801. This feature provides a unique, easy to use sequencer which is easy to make, low cost and durable.

A spring pin 64 is also included in the sequencer assembly 30. The spring pin 64 is received by aperture 66 in the housing 34. This spring pin 64 is rolled spring steel in the preferred embodiment. The spring pin 64 is received in the groove 45 of the interrupt 44 and retains the interrupt 44 after the flare pellet 22 and assembly 30 are launched so that no parts of the flare 10 will be caught in the aircraft after launch and damage it.

Referring again to FIG. 4, the flare 10 is shown assembled and before deployment. The case 12 holds the flare pellet 22, wrap 24, disk 26, tape, seal 28, and the sequencer assembly 30. When loaded into the launcher the impulse cartridge 18 is inserted into the case 12. The sequencer interrupt 44 is spring loaded within the slot 42 of the housing 34 by means of springs 46. Spring pin 64 is in place in aperture 66. The interrupt 44 blocks the aperture 62 at this time. The closure disk 16 is connected to the case 12 and insures that the other components of the flare 10 remain stationary until the flare is ignited and launched.

In operation, the launcher provides an electrical pulse to the impulse cartridge 18. This electrical pulse heats a resistance wire which in turn, fires an explosive charge within the cartridge 18. Hot gas and hot particles are formed from this explosion and are trapped in the free space in the skirt 36 of the sequencer assembly 30. These hot gases and hot particles build pressure in the free volume and force the sequencer assembly 30 forward to drive the flare pellet 22 from the case 12. The impulse cartridge 18 and case 12 stay within the launcher. The closure disk 16 is forced off of the case 12 when the assembly 30 and pellet 22 move forward and the closure disk 16 falls away from the flare 10. The sequencer assembly 30 acts like a piston against the flare pellet 22. At the same time that the assembly 30 is moving forward, the hot gas and hot particles travel through aperture 61 in the plug 60 and ignite the sequencer pellet 58.

As the flare pellet 22 and sequencer 30 leave the case 12 the interrupt 44 moves partially out of the housing 34 by action of the springs 46 but is held in the housing 34 by pin spring 64 as shown in FIG. 3. The interrupt 44 and springs 46 are retained by the pin 64 within the housing 34. After the interrupt 44 has moved aperture 62 is opened and the gas and particles of burning ignition pellet 58 pass through the aperture 62 and reach the flare pellet 22. The ignition material 32 in the grooves 23 of the flare pellet 22 is ignited and the material burns and ignites the flare pellet 22. As the ignition material 32 is igniting, the gas and flame front is propagating under the foil wrap 24, disk 26, and tape seal 28 (foil components) allowing the flame to continue burning until the flare pellet is fully ignited. During this time the foil components bum away and disintegrate. When the flare pellet 22 is ignited, flare intensity is reached.

The sequencer assembly 30 acts as a piston to move the flare pellet 22 out of the case 12 and further acts as a means for delay of the ignition of the pellet 22 until the flare pellet 22 is a safe distance from the aircraft.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize ether equivalents to the specific embodiments described herein which equivalents are also intended to be encompassed by the claims attached hereto.

What is claimed is:

1. A decoy flare, comprising:

(a) a case, having an aft and a forward portion and a forward opening;

(b) an impulse charge connected to the aft portion of the case;

(c) a segment of pyrotechnic material received within the case; and (d) a sequencer igniter to control the ignition of the pyrotechnic material received within the case and proximate the aft portion of the case and connected to the segment of pyrotechnic material, wherein the sequencer igniter comprises;

(i) a housing, the housing including an aperture;

(ii) an ignition pellet held within the housing;

(iii) an interrupt slidably received by the housing and positioned such that the aperture is covered, thereby separating the ignition pellet and the segment of pyrotechnic material; whereby when the impulse charge is ignited the segment of pyrotechnic material and sequencer igniter move out of the forward opening of the case, the ignition pellet is ignited, the interrupt slides partially out of the housing to uncover the aperture and the pyrotechnic material is ignited.

2. The flare of claim 1 further comprising a spring operatively engaging the interrupt, and applying an outwardly urging force on the interrupt, the interrupt being held in the housing by the case until the sequencer igniter has moved out of the case.

3. The flare of claim 1 further comprising a baffle positioned between the impulse charge and the ignition pellet of the sequencer igniter.

4. The flare of claim 1 further comprising a covering connected to the segment of pyrotechnic material whereby the ignition pellet is ignited and the ignition moves to the pellet, the gas and flame front propagates under the covering to ignite the pellet.

5. The flare of claim 4 wherein the covering is a sheet of adhesive backed aluminum foil.

6. The flare of claim 1 wherein the housing further includes a spacer for creating a space between the aft of the case and the sequencer igniter.

7. The flare of claim 2 further including a pin connected to the housing and cooperatively connected to the interrupt wherein the pin retains the interrupt in the housing.

8. The flare of claim 1 wherein the pyrotechnic material is generally an elongate cylinder having grooves in the longitudinal direction.

9. The flare of claim 1 wherein the diameter of the case is 36 mm.

10. The flare of claim 1 wherein the sequencer housing is made of nylon.

11. The flare of claim 1 further comprising a closure disk connected to the forward portion of the case.

12. The flare of claim 1 further comprising igniter material connected to the segment of pyrotechnic material whereby the ignition of the segment of pyrotechnic material is accelerated.

13. A decoy flare, comprising:

(a) a case having an aft and a forward portion and a forward opening:

(b) an impulse charge connected to the aft portion of the case;

(c) a segment of pyrotechnic material received within the case; and (d) a sequencer igniter to control the ignition of the pyrotechnic material received within the case and proximate the aft portion of the case and connected :to the segment of pyrotechnic material, wherein the sequencer igniter comprises;

(i) a housing, the housing including an aperture;

(ii) an ignition pellet held within the housing;

(iii) an interrupt slidably received by the housing and positioned such that the aperture is covered, thereby separating the ignition pellet and the segment of pyrotechnic material;

(iv) a spring operatively engaging the interrupt, and applying an outwardly urging force on the interrupt, the interrupt being held in the housing only by the case until the sequencer igniter has moved out of the case; whereby when the impulse charge is ignited the segment of pyrotechnic material and sequencer igniter move out of the forward opening of the case, the ignition pellet is ignited, the spring forces the interrupt partially out of the housing to uncover the aperture and the pyrotechnic material is ignited.

* * * * *